US006763970B2

(12) United States Patent
Harris et al.

(10) Patent No.: US 6,763,970 B2
(45) Date of Patent: Jul. 20, 2004

(54) DISPENSING SYSTEM FOR DISPENSING FACE MASKS FROM A STACK

(75) Inventors: Linda G. Harris, Lawrenceville, GA (US); Michael A. Amante, Arlington, VA (US); Daryl S. Bell, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 57 days.

(21) Appl. No.: 10/301,219

(22) Filed: Nov. 21, 2002

(65) Prior Publication Data

US 2004/0099677 A1 May 27, 2004

(51) Int. Cl.[7] ..... B65H 1/00
(52) U.S. Cl. ..... 221/33; 206/440
(58) Field of Search ..... 221/33, 45, 46, 221/63, 303; 206/440, 438, 278

(56) References Cited

U.S. PATENT DOCUMENTS 1,116,399 A 11/1914 Elsas
1,346,792 A 7/1920 Bergman
1,752,607 A 4/1930 Miller
2,115,923 A 5/1938 Cooper
3,435,988 A 4/1969 Jonas et al.
4,269,315 A 5/1981 Boyce
4,550,856 A 11/1985 Ballmann et al.
4,673,084 A * 6/1987 Hubbard et al. ..... 206/438
5,501,365 A 3/1996 Richiger et al.
5,899,356 A 5/1999 Huisman

* cited by examiner

*Primary Examiner*—Kenneth Noland
(74) *Attorney, Agent, or Firm*—Scott B. Garrison

(57) ABSTRACT

The invention relates to a system for dispensing face masks. The system includes a stack of masks arranged within an interior of a container. The container has a dispensing opening therein for the withdrawal of a single or a specific plurality of masks. The ties of the masks within the stack are arranged so that they extend along the interior walls of the container and rest upon the furthest surface of the mask furthest away from the dispensing opening.

27 Claims, 4 Drawing Sheets

DISPENSING SYSTEM FOR DISPENSING FACE MASKS FROM A STACK

BACKGROUND

The invention relates to face mask dispensers. Current face masks are typically dispensed from the top of an opened container. Due at least in part to the manner in which the masks are loaded into the dispenser the face mask ties often become entangled. Typically this results in the dispense of numerous masks when only one was intended. Often times the dispensing of multiple masks results in product waste and time delay. In the case of surgical masks, where sterility is at issue, removal of each mask from the dispenser potentially contaminates the mask and makes it unsuitable for use in surgery. Therefore when multiple masks are inadvertently dispensed, the additional masks being at risk of contamination should not be returned to the dispenser. Moreover, untangling the ties of individual masks from one another could result in valuable time wasted in a surgical setting. Additionally, since the masks are normally dispensed from the top of an open container, the top mask is often exposed to the environment each time the box is opened.

As such, what is needed is a face mask dispenser that can dependably and easily dispense the required number of face masks from a dispenser thereby minimizing the risk of exposing inadvertently disposed face masks to contamination. Additionally, it is desirable to minimize contamination of the stack of masks remaining within the interior of the dispenser as well.

SUMMARY OF THE INVENTION

As such, one aspect of the present invention discloses a dispensing system for individual planar shaped face masks from a stack of such masks. The dispensing system may include a container having a top, a bottom, and a plurality of walls that define an interior space. Additionally, a plurality of individual planar shaped face masks are included. Each mask may have a shape retaining element for conforming the mask to a user's face and a plurality of ties for securing the mask to the user's face. Each mask may be arranged in stacked relation with respect to an adjacent mask with the ties from substantially all of the masks disposed upon an uppermost surface of an uppermost mask in the stack. The container may have a dispensing opening having a length, a height, and a widened region defined in a lowermost portion of one of the plurality of walls. The length of the dispensing opening substantially corresponds to the length of the face mask and the height substantially corresponds to the thickness of the face mask. The plurality of face masks may be positioned so that the shape retaining element of each face mask is disposed proximal to the wall having the dispensing opening. A bottommost face mask of the stack is substantially aligned with the dispensing opening in a dispensing position and the widened region provides a location for the user to grip the bottommost mask proximal to the shape retaining element for extraction from the interior space of the container.

Another aspect of the present invention provides a dispensing system for dispensing individual face masks from a stack of such masks. The system includes a plurality of flat, rectangular, face masks each having a thickness, a length, and a width. Each mask has a shape retaining element and a flexible tie extending from each corner of the mask. The plurality of masks are arranged in stacked relation with the shape retaining element of each mask superposed with that of an adjacent mask and the flexible ties from each comer of each mask are generally mingled with the flexible ties from corresponding comers of the masks in the stack. The system also includes a container for storing and dispensing the plurality of masks. The container has a top, a bottom, a front wall, a back wall, and side walls that in combination define an interior space. The front wall may include a dispensing opening located at a bottommost portion of the front wall proximal to the bottom wall. The dispensing opening may have a length that corresponds about to the length of an individual mask, may have a height that corresponds about to the thickness of an individual mask, and may have a larger open region intersecting with the dispenser opening. The stack of masks are loaded into the interior space of the container so that the shape retaining element is disposed proximal the front wall such that the plurality of ties extend generally in an upward direction along the walls of the container from the bottom of the container toward the top of the container and at least partially rest upon an uppermost surface of the uppermost mask in the stack. The larger open region provides access to the bottommost mask for withdrawal from the interior of the container.

Another aspect of the present invention provides a dispensing system for dispensing face masks from a stack of such masks. The system includes a plurality of flat face masks each having a first and second surface, a thickness, a length, a width, and a plurality of flexible ties extending therefrom. The plurality of masks are arranged in stacked relation with the flexible ties of each mask generally mingled with the flexible ties of other masks in the stack. The system also includes a container for storing and dispensing the plurality of masks. The container has a plurality of walls defining an interior space and a dispensing opening located in at least one of the walls for dispensing face masks from the interior space. The dispensing opening has a length corresponding about to the length of the mask and a height corresponding about to the thickness of at least one mask. The stack of masks are loaded into the interior space of the container with the plurality of ties extending generally perpendicular to at least one mask surface, away from the dispenser opening and at least partially adjacent to at least one wall within the interior space.

DESCRIPTION OF THE INVENTION

Figure 1:
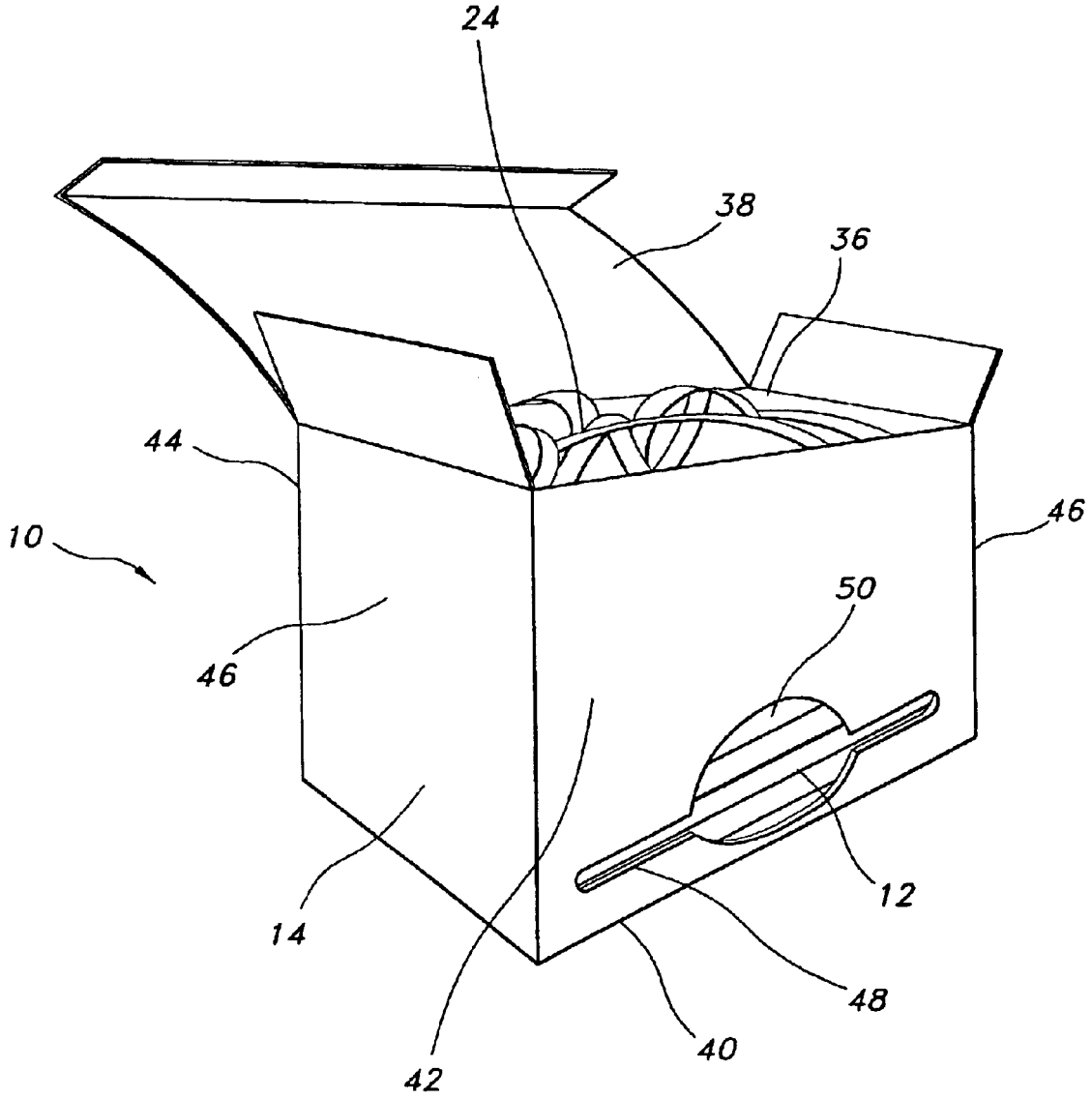
FIG. 1 is a perspective view of a dispensing system in accordance with the present invention.

The present invention and its advantages are best understood by referring to the drawings, like numerals being used for like and corresponding parts of the various drawings.

With reference to FIG. 1, the present invention provides a dispensing system 10 for dispensing face masks 12 from a container 14. In certain embodiments such as that shown in FIG. 2, the face masks 12 may be flat and rectangular in profile. Each face mask 12 may have a length "L1", a width "W1", and a thickness "T1" (as depicted on FIG. 4). Additionally, each face mask 12 comprises a first surface 16 and a second surface 18. One of the two surfaces 16, 18 is intended to be placed against a user's face and is to be referred to as an inner surface 20. Likewise the remaining surface is to be referred to as an outer surface 22 and is intended to face away from the user toward the environment.

Additionally some manner for securing the face mask 12 to the user's face should be provided. In certain embodiments, a plurality of flexible ties 24 may be provided to perform this function. These ties 24 may be attached to the face mask 12 in any number of fashions including but not limited to adhesive, ultrasonic bonding, thermal bonding, and/or stitching. The ties 24 may be formed into the face mask 12 itself and/or may be threaded through suitable pathways contained in the face mask 12 (not shown).

Figure 2:
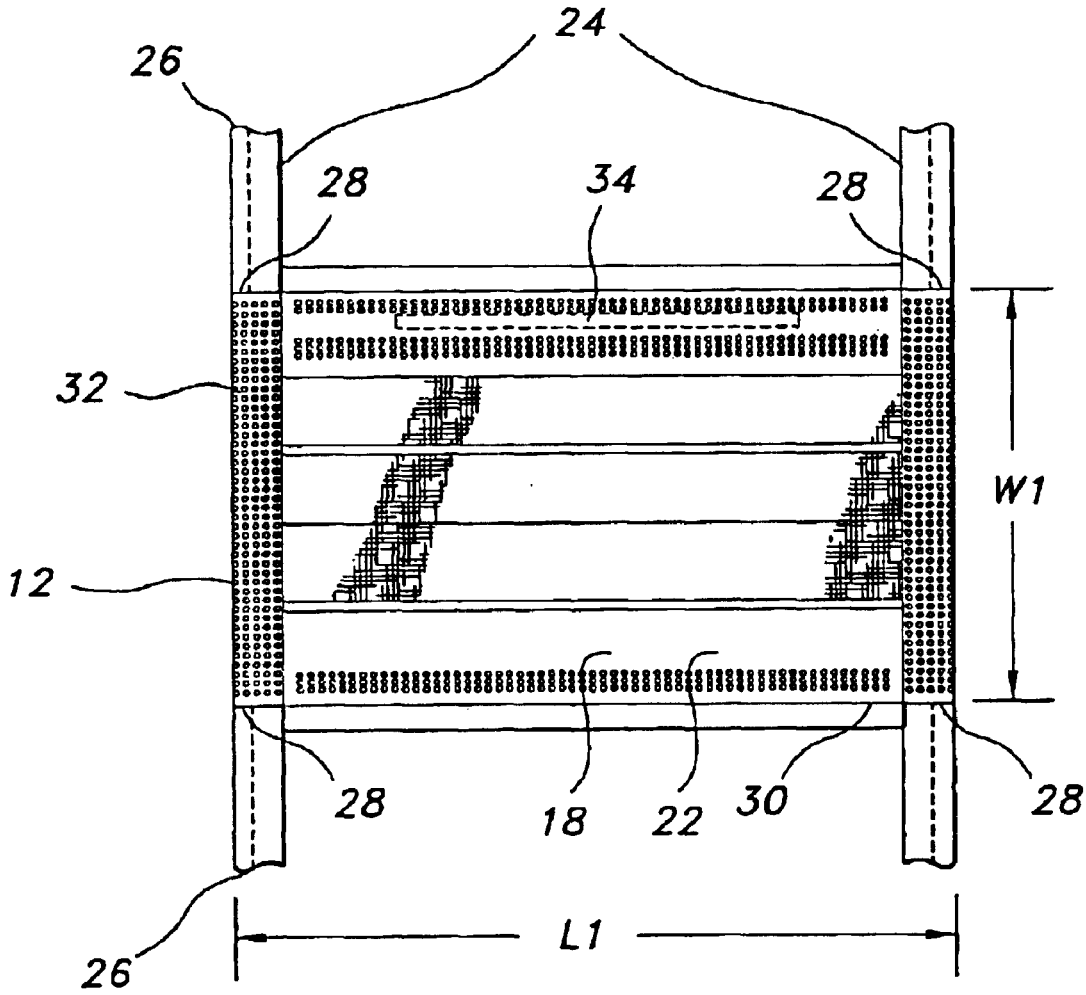
FIG. 2 is a plan view of one possible mask configuration for the FIG. 1 system.

In certain embodiments, such as shown in FIG. 2, these ties 24 may be attached to the face mask 12 such that ends 26 extend from the face mask 12. Other embodiments envision attaching the tie 24 to the face mask 12 by one end 26 enabling the other end 26 to extend from the face mask 12. Looking still to FIG. 2, it may be seen that in one embodiment the face mask 12 is generally rectangular in shape having corners 28 and opposing edges 30 and 32. In such an embodiment the ties 24 may be positioned such that at least a portion of a tie 24 extends from each corner of the face mask 12. The ties 24 themselves may be, for example, attached to opposing edges 30 of the face mask 12.

In certain embodiments, the face mask 12 comprises a shape retaining element 34 for conforming the mask to the user's nose. The shape retaining element 34 may be a conformable wire, strip of metal, or some other element capable of being bent into a shape and generally able to retain that shape. Many versions of shape retaining elements for face masks are known by and available to those skilled in the art.

Figure 3:
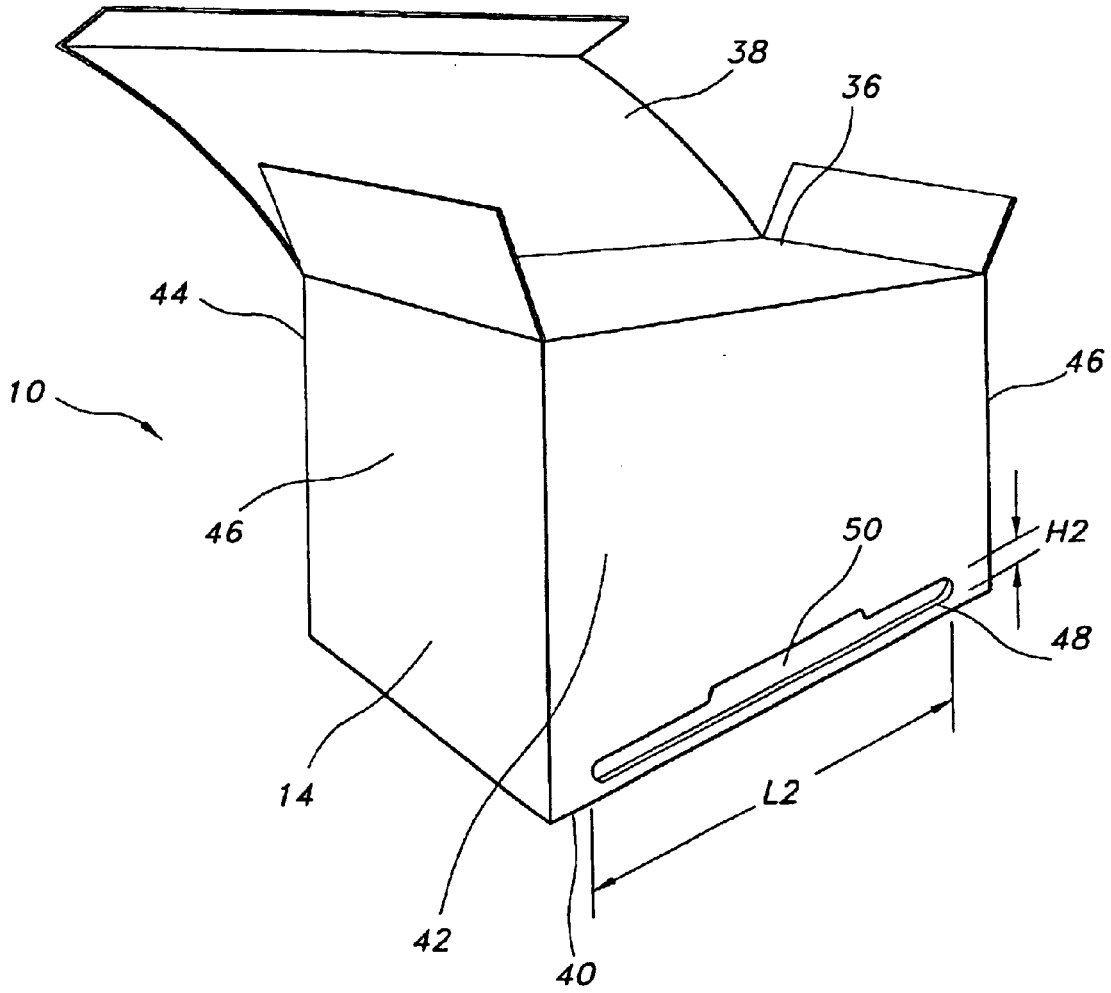
FIG. 3 is a perspective view of one possible container configuration for the FIG. 1 system.

Looking now to FIG. 3, one example of the container 14 is shown. In this particular embodiment it can be seen that the container 14 comprises a plurality of walls which define an interior space 36. The walls may include a top 38, a bottom 40, a front 42, a back 44, and side walls 46. The container 14 may be made of a variety of materials. Some embodiments may include cardboard, paperboard, plastics, metals, as well as other rigid and semi-rigid materials. One possible embodiment as depicted in FIG. 3 contemplates that the container 14 be disposable once the face mask supply is exhausted and therefore a stiff paperboard container would be suitable for this purpose. Other embodiments, not shown, may include permanent containers, including for example wall mounted units.

Looking still to FIG. 3, a dispensing opening 48 is provided in at least one of the walls of the container 14. In some embodiments the dispensing opening 48 is provided in the front 42 proximal to the top 38 or bottom 40. The dispensing opening 48 enables a user to access and remove at least one of the face masks 12 contained within the interior space 36. The dispensing opening 48 has a length "L2" and a height "H2". In many embodiments, the length "L2" of the opening 42 corresponds generally to the length "L1" of any one of the face masks 12. The height "H2" may generally correspond to the thickness "T1" of at least one of the face masks 12. However, in the event the container 14 is designed to dispense a plurality of masks 12 simultaneously, the height "H2" would be sized accordingly as understood by those skilled in the art.

Some embodiments of container 14 comprise a widened region or larger open region 50 that partially or fully overlaps some portion of the dispensing opening 48. In some embodiments, this region 50 may be centered horizontally, vertically, or both on the dispensing opening 48. However, it may be positioned in any other fashion desired so that it partially or fully overlaps any portion of the dispensing opening 48. Moreover a plurality of such regions 50 may be provided. One possible advantage provided by the addition of region or regions 50 is to enable a user to have easier access to a face mask or face masks within the container 14.

Figure 4:
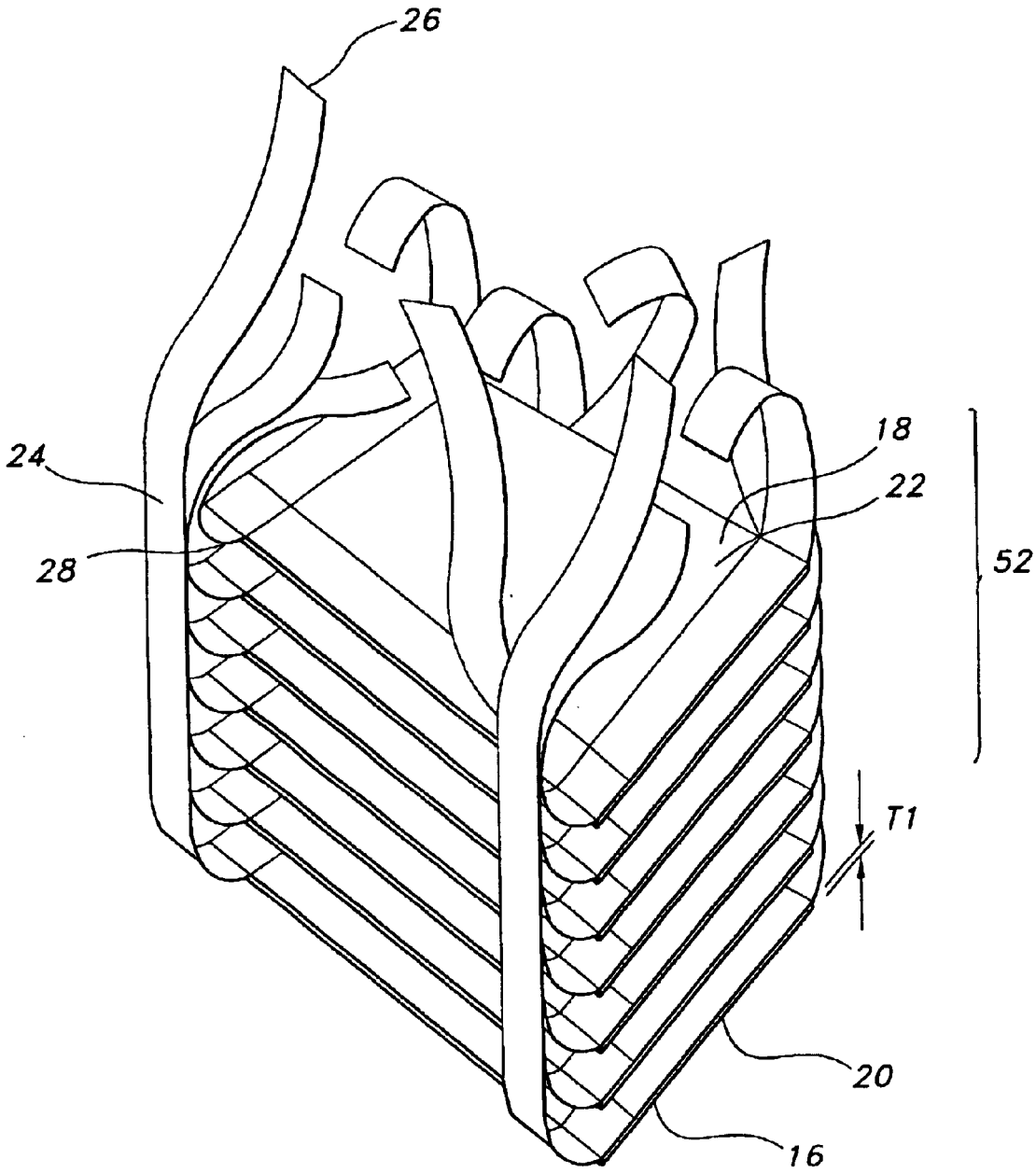
FIG. 4 depicts a stack of the FIG. 2 masks.

Turning to FIG. 4 it may be seen that the face masks 12 are arranged in-a stacked, aligned relation superposed one upon another to form stack 52. In some arrangements, stacking of the masks 12 may be accomplished by orienting the inner surface 20 of each mask in the same direction so that the inner surface 20 of one mask 12 is in contact with the outer surface 22 of the next mask 12. Further, some configurations provide that the masks 12 are arranged such that the shape retaining member 34 of each mask 12 is also stacked and superposed one upon another.

As can be seen in FIG. 4 the flexible ties 24 of each mask 12 are generally allowed to mingle with one another upon formation of the stack 52. The stack 52 may subsequently be loaded into the interior space 36 of the container 14 so that the plurality of ties 24 extend generally, for example, in an upward direction along the walls of the container 14 from the bottom 40 of the container 14 toward the top 38 of the container 14 and at least partially rest upon an uppermost surface of the uppermost mask 12 in the stack 52. It would be understood by those skilled in the art that the direction in which the ties 24 lie is dependent upon how the masks 14 are loaded into the container 14. In any event, in one embodiment, the plurality of ties 24 extend along the walls of the container 14 so that ends 26 lie upon the furthest surface 20 or 22 of the furthest mask 12 from the dispensing opening 48.

Other embodiments contemplate a plurality of groups of stacked masks 12. Each of these groups may subsequently assembled into the stack 52. In this embodiment, the ties 24 of each group are placed so that the ends 26 of those ties 24 lie upon one surface 20 or 22 of one of the endmost masks 12 in the group. Therefore when the groups are formed into the stack 52, some plurality of the ends 26 will be situated between masks 12 and others will be situated upon the furthest surface 20 or 22 of the furthest mask 12 from the dispensing opening 48.

In some embodiments, the stack is oriented so that the shape retaining element 34 is disposed proximal the front wall 42. In this embodiment, the dispensing opening 48 may also be on the front wall 42. This configuration enables the user to grasp a face mask 12 by the shape retaining element 34. An advantage to this configuration is that as the face mask 12 is withdrawn from the container 14, the shape retaining element 34 is partially preshaped to fit the user's face during the extraction of the mask 12 from the dispenser 14. As such the dispensing and first step of donning the face mask 12 are concurrent. Regardless of the manner in which the masks 12 are stacked within the container 14, the dispensing opening 48 minimizes the exposure of the mask surfaces 20 and 22 to air contamination.

Although the present invention and its advantages have been described in detail, it should be understood that various changes, substitutions, and alterations can be made therein without departing from the spirit and scope of the invention as defined by the appended claims.

What is claimed is:

1. A dispensing system for individual planar shaped face masks from a stack of such masks comprising:

a container having a top, a bottom, and a plurality of walls defining an interior space;

a plurality of individual planar shaped face masks, each comprising a shape retaining element for conforming the mask to a user's face, and a plurality of ties for securing the mask to the user's face, and each mask arranged in stacked relation with respect to an adjacent mask with the ties from substantially all of the masks disposed upon an uppermost surface of an uppermost mask in the stack;

a dispensing opening having a length, a height, and a widened region defined in a lowermost portion of one of the plurality of walls, the length substantially corresponding to the length of the face mask and the height substantially corresponding to the thickness of the face mask, the plurality of face masks positioned so that the shape retaining element of each face mask is disposed proximal to the wall having the dispensing opening and a bottommost face mask of the stack is substantially aligned with the dispensing opening in a dispensing position, the widened region providing a location for the user to grip the bottommost mask proximal to the shape retaining element for extraction from the interior space of the container.

2. The system of claim 1 wherein the mask is a surgical mask.

3. The system of claim 1 comprising two ties, each having a length and two ends, each be attached to opposing edges of the mask such that the two ends of each tie extend beyond the comers of the mask.

4. The system of claim 3 wherein the ties are bonded to the mask.

5. The system of claim 1 wherein the widened region is centered on the dispensing opening.

6. The system of claim 1 wherein the widened region is centered on the length of the dispensing opening.

7. The system of claim 1 wherein the widened region is centered on the height of the dispensing opening.

8. The system of claim 1 comprising a plurality of widened regions, each overlapping the dispensing opening.

9. The system of claim 1 wherein the shape retaining element comprises a conformable wire.

10. A dispensing system for dispensing individual face masks from a stack of such masks comprising:

a plurality of flat, rectangular, face masks each having a thickness, a length, and a width, each mask comprising a shape retaining element and a flexible be extending from each corner of the mask, the plurality of masks arranged in stacked relation with the shape retaining element of each mask superposed with that of an adjacent mask and the flexible ties from each comer of each mask generally mingled with the flexible ties from corresponding comers of the masks in the stack;

a container for storing and dispensing the plurality of masks, the container comprising a top, a bottom, a front wall, a back wall, and side walls that in combination define an interior space, the front wall comprising a dispensing opening located at a bottommost portion of the front wall proximal to the bottom wall, the dispensing opening having a length that corresponds about to the length of an individual mask, having a height that corresponds about to the thickness of an individual mask, and having a larger open region intersecting with the dispenser opening, the stack of masks loaded into the interior space of the container with the shape retaining element disposed proximal the front wall such that the plurality of ties extend generally in an upward direction along the walls of the container from the bottom of the container toward the top of the container and at least partially rest upon an uppermost surface of the uppermost mask in the stack, the larger open region providing access to the bottommost mask for withdrawal from the interior of the container.

11. The system of claim 10 wherein the larger open region is centered on the dispensing opening.

12. The system of claim 10 wherein the larger open region is centered on the length of the dispensing opening.

13. The system of claim 10 wherein the larger open region is centered on the height of the dispensing opening.

14. The system of claim 10 comprising a plurality of larger open regions, each overlapping the dispensing opening.

15. The system of claim 10 wherein the shape retaining element comprises a conformable wire.

16. A dispensing system for dispensing face masks from a stack of such masks comprising:

a plurality of flat face masks each having a first and second surface, a thickness, a length, a width, and a plurality of flexible ties extending therefrom, the plurality of masks arranged in stacked relation with the flexible ties of each mask generally mingled with the flexible ties of other masks in the stack;

a container for storing and dispensing the plurality of masks, the container comprising a plurality of walls defining an interior space, and a dispensing opening located in at least one of the walls for dispensing face masks from the interior space, the dispensing opening having a length corresponding about to the length of the mask and a height corresponding about to the thickness of at least one mask, the stack of masks loaded into the interior space of the container with the plurality of ties extending generally perpendicular to at least one mask surface, away from the dispenser opening, and at least partially adjacent to at least one wall within the interior space.

17. The system of claim 16 wherein the face masks comprise surgical masks.

18. The system of claim 16 wherein the face masks are generally rectangular in shape.

19. The system of claim 16 comprising at least one shape retaining member in each mask for molding the shape of the mask to a user's face.

20. The system of claim 19 wherein the shape retaining member comprises a bendable wire.

21. The system of claim 19 wherein the stack of masks is oriented such that each shape retaining member is stacked upon an adjacent shape retaining member of an adjacent mask.

22. The system of claim 21 wherein the stack is loaded into the interior space so that the shape retaining member of each mask is disposed adjacent to the dispensing opening prior to the mask's removal from the interior space.

23. The system of claim 16 wherein one of the mask surfaces comprises an outer surface, the stack is loaded into the interior space so that at least some portion of the outer surface of each mask in turn, prior to dispensing, is exposed through the dispensing opening.

24. The system of claim 16 wherein the plurality of walls comprise a bottom wall and a top wall separated from one another by at least one other of the walls, wherein the dispensing opening is located In the at least one other wall at a location adjacent the bottom wall.

25. The system of claim 16 wherein the plurality of walls comprise a bottom wall and a top wall separated from one another by at least one other of the walls, wherein the dispensing opening is located in the at least one other wall at a location adjacent the top wall.

26. The system of claim 16 further comprising at least one additional opening located in and extending through one of the walls to the interior space, the at least one additional opening intersecting the dispensing opening so that at least some portion of the dispensing opening is effectively made larger than a remainder of the dispensing opening to assist dispense of the masks from the interior space.

27. The system of claim 16 wherein the stack of masks comprises a plurality of group of stacked masks, wherein the plurality of ties of each group of stacked masks are overlapped upon an outermost mask in that particular group of stacked masks, and each group of stacked masks is in turn stacked upon another group of stacked masks to form the stack of masks.

* * * * *

UNITED STATES PATENT AND TRADEMARK OFFICE

CERTIFICATE OF CORRECTION

PATENT NO. : 6,763,970 B2
DATED : July 20, 2004
INVENTOR(S) : Harris et al.

It is certified that error appears in the above-identified patent and that said Letters Patent is hereby corrected as shown below:

Column 5,
Lines 28 and 47, “be” should read -- tie --;
Lines 30 and 54, “comers” should read -- corners --;
Line 52, “comer” should read -- corner --.

Signed and Sealed this

Sixth Day of September, 2005

JON W. DUDAS
*Director of the United States Patent and Trademark Office*